United States Patent [19]

Garg et al.

[11] Patent Number: 4,627,913

[45] Date of Patent: Dec. 9, 1986

[54] CATALYTIC COAL LIQUEFACTION WITH TREATED SOLVENT AND SRC RECYCLE

[75] Inventors: Diwakar Garg, Macungie; Edwin N. Givens, Bethlehem; Frank K. Schweighardt, Allentown, all of Pa.

[73] Assignee: Air Products and Chemicals, Inc., Allentown, Pa.

[21] Appl. No.: 690,009

[22] Filed: Jan. 9, 1985

[51] Int. Cl.[4] ..... C10G 1/06

[52] U.S. Cl. ..... 208/415; 208/417; 208/418; 208/419; 208/421; 208/422

[58] Field of Search ..... 208/10, 415, 417, 418, 208/419

[56] References Cited

U.S. PATENT DOCUMENTS

| | | | |
|---|---|---|---|
| Re. 25,770 | 4/1965 | Johanson | 208/10 |
| 2,227,672 | 1/1941 | Pier et al. | 196/53 |
| 3,321,393 | 5/1965 | Schuman et al. | 208/10 |
| 3,412,010 | 11/1968 | Alpert et al. | 208/112 |
| 3,519,555 | 7/1970 | Keith et al. | 208/10 |
| 3,700,584 | 10/1972 | Johanson et al. | 208/10 |
| 4,056,460 | 11/1977 | Malek | 208/8 |
| 4,057,484 | 11/1977 | Malek | 208/8 |
| 4,081,351 | 3/1978 | Heinemann | 208/10 |
| 4,102,775 | 7/1978 | Quaderer et al. | 208/10 |
| 4,119,523 | 10/1978 | Baldwin et al. | 208/8 |
| 4,124,485 | 11/1978 | Carr et al. | 208/8 LE |
| 4,125,452 | 11/1978 | Effron et al. | 208/10 |
| 4,133,646 | 1/1979 | Farcasiu et al. | 44/1 R |
| 4,136,013 | 1/1979 | Moll et al. | 208/10 |
| 4,350,582 | 9/1982 | Rosenthal et al. | 208/10 X |
| 4,397,732 | 8/1983 | Hoover et al. | 208/10 X |
| 4,411,766 | 10/1983 | Garg et al. | 208/10 |
| 4,428,820 | 1/1984 | Kuehler et al. | 208/10 |
| 4,461,694 | 7/1984 | Givens et al. | 208/8 LE |
| 4,472,263 | 9/1984 | Garg et al. | 208/8 LE |
| 4,472,273 | 9/1984 | Hagihara | 210/15.9 |

*Primary Examiner*—Andrew H. Metz
*Assistant Examiner*—William G. Wright
*Attorney, Agent, or Firm*—Geoffrey L. Chase; E. Eugene Innis; James C. Simmons

[57] ABSTRACT

A process for the solvent refining of coal to distillable, pentane soluble products using a dephenolated and denitrogenated recycle solvent and a recycled, pentane-insoluble, solvent-refined coal material, which process provides enhanced oil-make in the conversion of coal.

8 Claims, 2 Drawing Figures

CATALYTIC COAL LIQUEFACTION WITH TREATED SOLVENT AND SRC RECYCLE

TECHNICAL FIELD

The Government of the United States of America has rights in this invention pursuant to Contract No. DE-AC22-82PC50003 awarded by the U.S. Department of Energy.

The present invention is directed to the production of synthetic distillable fuel oils from nonanthracitic coals. The process is directed to the production of pentane-soluble, distillable hydrocarbon products and normally solid, pentane-insoluble, solvent-refined coal from raw coal or pretreated coal material. More particularly, the present invention is directed to an improved solvent refining process for coal in which process solvent treated for the extraction of nitrogenous base and phenolic compounds is used in conjunction with a recycle stream of pentane-insoluble, solvent-refined coal to effect an enhanced oil-make.

BACKGROUND OF THE PRIOR ART

Coal liquefaction has been practiced since the 1920s and 1930s, starting in Germany, up until the present shortages of available petroleum products during the current energy shortages. The early coal liquefaction techniques utilized large amounts of hydrogen and extremely high pressure conditions in order to provide liquid fuel products from coal. Both of these criteria provide for an unfavorable economic production scheme. More recently, coal has been liquefied in various catalytic and thermal solvent refining techniques. Coals which are amenable to such processing include the nonanthracitic coals such as bituminous, sub-bituminous and lignitic coals, as well as other organic materials, such as peat.

When coal liquefaction is performed either with or without solvent, but in the presence of an added catalyst, it is termed a catalytic coal conversion technique. When coal is liquefied without the addition of external catalysts, but potentially in the presence of catalytic materials indigenous to the coal, such a processing is referred to as a thermal coal liquefaction. It is known to catalyze coal liquefaction by various catalysts such a molybdenum, cobalt, nickel, iron and combinations of these elements and their compounds.

Coal liquefaction can also be accomplished either with or without a solvent for the raw feed coal material. In those processes utilizing a solvent, generally termed solvent refining of coal, the solvent is typically recovered from the downstream product separation zone and is recycled for further use in the process. It is also known to recycle SRC specifically for those processes which utilize a solvent to effect the coal liquefaction. SRC is an abbreviation of the term solvent refined coal and is recognized in the art as constituting that portion of the nondistillable, pentane-insoluble products of the solvent refining of coal which portion is soluble in tetrahydrofuran, creosol or pyridine. When SRC is recycled in a coal liquefaction process, the second or subsequent passes of the SRC through the process are presumed to effect the further conversion of the SRC material to pentane-soluble and distillable products.

In recycling hydrogen donor solvent, the prior art has performed various separations and purifications of the recycle solvent in order to benefit the reaction to which the solvent is introduced. For example, U.S. Pat. No. 4,056,460 teachs the beneficial effect of recycling or adding amines and phenols as coal solvent constituents. A process is described in which phenols and amines are extracted from coal liquids and are recycled to the liquefaction zone. The patent identifies the phenolic functionalities in asphaltenes and states that although asphaltenes should not be recycled to the liquefaction reaction, after a reduction in molecular weight, the corresponding phenols are beneficial recycle solvents.

U.S. Pat. No. 4,057,484 disclosed that the acid-base structures in asphaltenes must be decomposed with either acid alone or caustic alone before a portion of the asphaltenes are recycled as pasting solvent for coal liquefaction.

U.S. Pat. No. 4,081,351 discloses a process utilizing coal extract which is denitrogenated before going to a catalytic cracker reaction vessel in order to protect the catalyst in the hydrocracker from nitrogenous components.

U.S. Pat. No. 4,125,452 discloses a coal liquefaction process in which a recycle solvent is separated from phenol-containing material and the phenol-free solvent is rehydrogenated before recycle to a coal liquefier.

In U.S. Pat. No. 4,133,646 it is stated that a coal liquefaction process, wherein 3–50% of phenols are recycled as solvent, is the desired goal of the patent process.

In addition, U.S. Pat. No. 4,472,263 to the same inventors herein and of common assignee discloses that recycle solvent in a solvent refining of coal can be treated to remove the phenol and nitrogenous base constituents therefrom. Further, this patent discloses that light SRC or predominantly benzene-soluble, solvent-refined coal may be recycled to the slurry mix tank of the coal liquefaction scheme of that patent. No examples are given to demonstrate the result of such an SRC recycle. The issue date of that patent is within one year of the filing date of this present invention.

In U.S. Pat. No. 4,411,766 it is disclosed that solvent-refined coal or SRC can be recycled as shown in FIG. 2 of that patent or as only the light solvent-refined coal as shown in FIG. 1 of that patent.

The present invention improves upon the teachings of the prior art wherein a novel combination of treated recycle solvent and SRC or a portion thereof is recycled in a catalytic process to provide an unexpected increased oil-make in the coal liquefaction or solvent refining process.

BRIEF SUMMARY OF THE INVENTION

The present invention constitutes a process for the catalytic solvent refining of coal at elevated temperature and pressure in a hydrogen atmosphere using a hydrocarbon solvent boiling in the range of 350°–950° F. in which a predominant amount of the phenolic and nitrogenous base constituents are removed when the solvent is recycled and in which the solvent refining is performed in the presence of an added catalyst to produce liquid hydrocarbons and normally solid, solvent-refined coal, wherein at least a portion of the pyridine-soluble, pentane-insoluble, solvent-refined coal is recycled to the process.

Preferably the process of the present invention is performed wherein at least a portion of only a predominantly benzene-insoluble solvent-refined coal is recycled to the process.

Optimally, the process of the present invention is catalyzed with a catalytic amount of molybdenum or a molybdenum compound and other metals and their compounds.

DETAILED DESCRIPTION OF THE INVENTION

Figure 1:
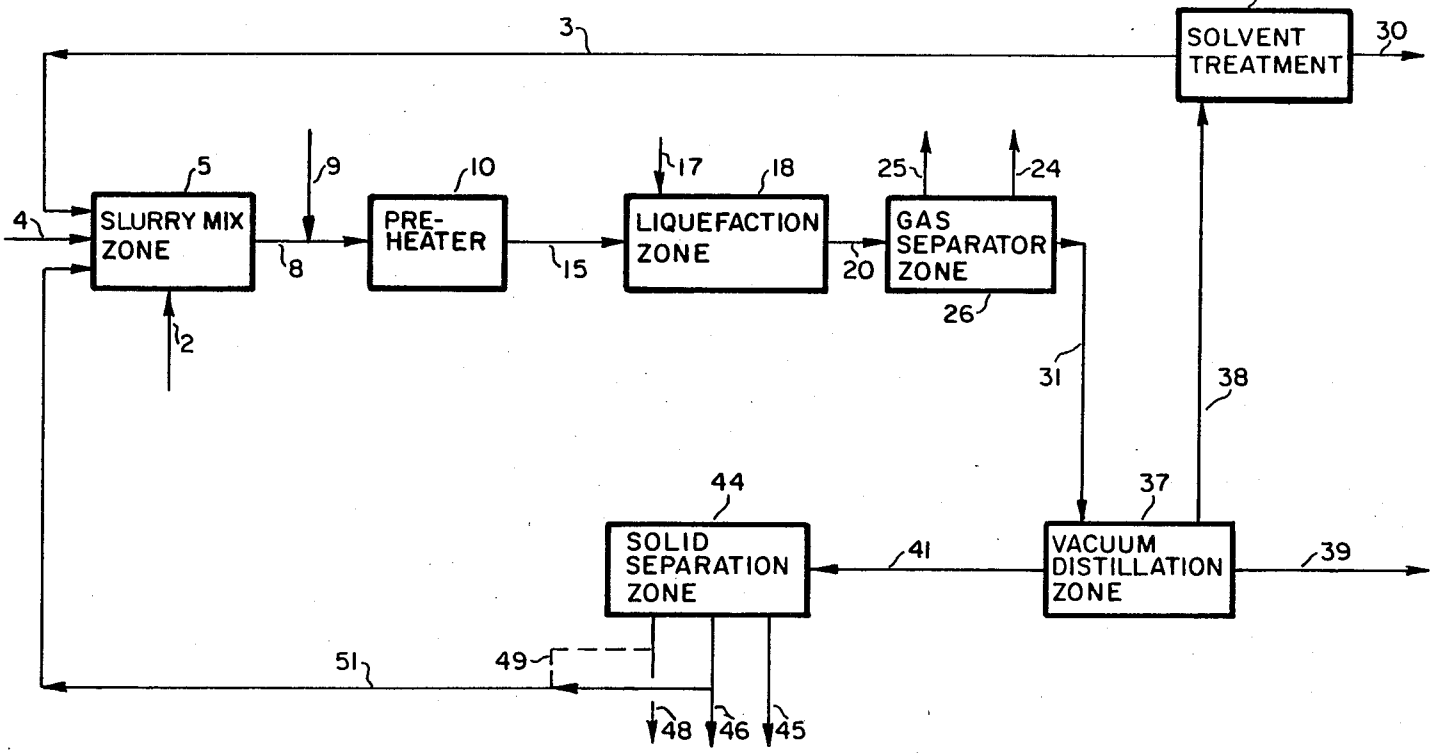
FIG. 1 represents a schematic flowscheme of a preferred embodiment of the present invention.

The present invention is applicable to a broad range of coal liquefaction techniques utilizing a catalyzed system. Applicable techniques include those coal liquefaction or solvent refining processes which utilize (1) a solvent for the coal which is recycled to the process, (2) a recycle of solvent refined coal or SRC and (3) a catalyst system for the actual liquefaction reaction. Such coal processes include the H-Coal, Synthoil and Dow processes which are well known to those skilled in the art. Two particular specific methods for practicing the present invention are the slurry catalyzed coal liquefaction process and the ebullated bed catalytic process for coal liquefaction. The invention will be described with respect to each of these general techniques for performing coal liquefaction or solvent refining as set forth below. It is generally understood that coal liquefaction and solvent refining are used interchangeably in the art although solvent refining is a coal liquefaction which requires the use of solvent whereas coal liquefaction can include techniques which do not use solvent.

In a slurry catalyzed coal liquefaction process or solvent refining technique, coal is liquefied with a disposable catalyst. Fresh catalyst and feed coal are continuously slurried with solvent, preferably recycle solvent and the liquefaction products are continually separated to remove coal minerals, solvent-refined coal and spent catalyst from the coal liquefaction liquid products. This technique requires an inexpensive disposable catalyst to avoid extreme catalyst costs with the once through use of such catalyst. However, the benefit is the avoidance of catalyst deactivation, which is typically caused by the blockage of active sites on the catalyst surface by mineral matter in the coal or the deposition of carbon on the catalyst surface from hydrogen deficient coal molecules.

Slurry catalyzed coal liquefaction can be performed with a soluble catalyst which is impregnated on the coal or by other slurry catalyst techniques such as set forth in U.S. Pat. Nos. 4,102,775 and 4,136,013 hereby incorporated by reference, respectively.

Suitable catalysts include any of the known hydrogenation catalysts such as the oxides and sulfides of transition metals particularly Group VIII and VIB. The catalyst can be used individually or in combination and in a supported or unsupported form. The catalysts include metals from Groups IVB, VB, VIB, VIIB, and VIII such as iron, cobalt, nickel and mixtures thereof. The metals can be used individually or in various combinations as taught in U.S. Pat. No. 2,227,672 incorporated herein by reference. The catalyst can be in the form of water soluble or organic compound soluble salts which are either impregnated on the feed coal, emulsified in the solvent, or added to a coal/solvent slurry. Suitable supported catalysts include Co-Mo-Al, Ni-Mo-Al, Ni-W, and Co-W. Suitable supports are alumina, silica, zirconia, activated carbon, magnesia, and titania. Activated clays can also be used as catalyst support. Oil soluble metal compound catalysts can also be used. Suitable oil soluble catalysts include: (1) inorganic metal halides, oxyhalides and heteropoly acids, (2) metal salts of organic acids, such as acyclic, alicyclic aliphatic organic acids, (3) organometallic compounds and (4) metal salts or organic amines and phenols. Particulate catalysts can also be used, such as pyrite, iron oxides, red mud, iron sulfate, zinc sulfide, low concentration of metals, such as molybdenum, nickel, cobalt and their compounds and combinations.

Nonanthracitic coals including bituminous, subbituminous or lignitic coals and mixtures thereof are suitably slurried with the catalyst in the coal solvent as the starting material for the process. The coal is typically dried and can be preliminarily treated to remove excess rock or low carbonaceous content matter before being sized and incorporated into the catalytic coal slurry feed.

The pasting or slurry solvent is typically an anthracene oil, a creosote oil or other coal-derived liquid with a boiling point of not lower than 375° F. The solvent should make up from 45–90% of the total slurry content and have a consistency that can be processed through a typical pumping unit into a high pressure reaction system. The coal concentration in the feed slurry to the process should be between 10 and 55% by weight, typically about 35–55% by weight. At lower concentrations, the coal throughput is so low that it becomes uneconomical to run the process, while at the high concentrations the viscosity in the feed slurry and subsequent downstream equipment becomes excessive, making handling inconvenient.

In addition, the feature of the present invention which is unique to coal processing is the incorporation of solvent which is treated to remove nitrogenous base components and phenolic components therefrom. Typically, this is done in recycling solvent from the downstream equipment to the feed area of the slurry mix zone of the process. A predominant amount of both the nitrogenous base compounds and the phenolic compounds in the solvent should be removed, although it is preferred to remove essentially all of these compounds. In conjunction with the use of this treated solvent, the unexpected benefits of the present invention are also derived by the recycle of solvent refined coal. The amount of SRC recycle should be between 2 and 50% of the coal, typically about 10 to 50% by weight of the coal.

The treated solvent, the sized and slurried coal, along with catalyst and recycled SRC constitute the coal slurry which is combined with high pressure hydrogen-rich gas and then injected into a preheater at a velocity of from 8–20 ft./sec. with increasing temperature up to approximately 600°–825° F. with the residence time between 1 and 15 minutes, more preferably between 1 and 10 minutes and a pressure of 500–5000 psig. Considerable dissolution of the coal occurs in the preheater zone. The high temperature coal slurry, in dissolved form from the preheater, along with additional hydrogen is then introduced to a dissolver or a liquefaction zone and has a residence time in such zone of between 25 and 90 minutes at a temperature of 750°–900° F. Superficial flow rates through the dissolver zone or liquefaction zone of the process are chosen to maintain good agitation in the reactor. Superficial gas rates will be from 0.05 to 3.0 ft./sec. and the superficial liquid velocities will generally be between 0.003 to 0.1 ft./sec. The ratio of total hydrogen gas to total slurry feed is maintained at a level to insure a hydrogen concentration in the exit slurry of at least 50 mole% and more preferably greater than 70 mole%.

The liquefaction zone or dissolver contents are passed to a high pressure separating zone where the effluent is flashed at a temperature of from 150° F. to within about 50° F. of the reactor outlet temperature. The overhead stream comprised of light gases, including hydrogen, hydrogen sulfide, carbon monoxide, carbon dioxide, ammonia, water and $C_1$ to $C_4$ light gases plus heavier hydrocarbons and phenolic materials are passed to additional condensing fractionation and scrubbing equipment. Acidic and alkaline components are removed from the light gas and the resulting hydrogen rich stream is recycled to various stages in the process or burned as fuel. The underflow from the flash separation zone or gas separator zone is removed for distillation of the solvent and liquid product and separation of solid material from liquid product. In such a process, at least three streams are obtained as product or intermediate products: (a) light distillates up to about a 450° F. boiling point, (b) recycle solvent boiling in a range of about 350° to 950° F. and (c) residual solvent refined coal with an initial boiling point in the range of 800°-1050° F.

Alternately, the process of the present invention could be used in the context of an ebullated catalytic process for the liquefaction of coal as has already been disclosed in a large number of patents. The H-Coal process owned by Hydrocarbon Research Incorporated is the best example of the specific application of the ebullated catalytic bed. In such a bed the dissolver is operated with a hydroprocessing catalyst which is not directly slurried with the feed. Rather, the feed is introduced in an upflow manner through catalyst particles forming a bed in the ebullated dissolver zone which upflow is sufficient to place the catalyst bed in an ebullated condition. Sufficient overflow of catalyst is provided such that aged catalyst is continually withdrawn and fresh catalyst added to the bed. This addition and withdrawal can be performed without interrupting the steady state operation of the unit. By proper selection of reactor dimensions, reactor dynamics and catalyst particle size, the catalyst will remain in the reactor and not be carried out of the reactor with the reactor effluent. In the ebullated state, the catalyst bed will be at least 10% expanded over the settled area. Within the context of operating with an ebullated bed, the characteristics of the process outside the bed will be similar to that defined for the slurry catalyzed process. Specifically, coal selection and preparation are similar, process solvent is similar, the SRC recycle is similar and the feed slurry concentration is similar. However, hydrogen feed rate in the ebullated bed reactor will tend to be higher than in the first slurry catalyzed process. In the ebullated bed reactor, a catalyst which is comprised of beads, pellets, lumps, chips or particles of a size up to about ¼" are maintained in random motion by upflowing streams. The size and shape of a catalyst particle will depend upon the particular conditions of the process. In order to generate the necessary liquid velocities to expand the bed, while not having to make the linear velocities through the system exorbitantly large, liquid is recycled around the reactor. The beneficial method of performing this circulation without requiring external heating steps is to perform the recycle either within the reactor itself or in a recycle line close to the unit itself. Extensive discussion of the design and operation of ebullated reactors is contained in the following patents from Hydrocarbon Research Incorporated: U.S. Pat. No. Re. 25,770, U.S. Pat. Nos. 3,321,393, 3,412,010, 3,519,555 and 3,700,584 incorporated by reference herein, respectively.

One preferred feature of either embodiment of coal processing with slurry catalyzed operation or ebullated bed operation is the incorporation of a critical solvent separation system. In this process, a critical solvent separation operation is employed for removing the ash and unreacted coal from the liquefaction product. Such a system is set forth in U.S. Pat. No. 4,119,523 assigned to Kerr-McGee and is hereby incorporated by reference herein. In a critical solvent deashing system, hot vacuum still bottoms which contain dissolved carbonaceous product and unconverted coal macerals plus a small amount of remaining process solvent are transferred to a mix tank to which is added the critical deashing solvent. The weight ratio of the deashing solvent to vacuum still bottoms will be approximately from 1 to 10. After completing a mixing step, the resulting slurry is introduced at a pressure from 750 to 1000 psig and at a temperature from 450° to 630° F. into a first separator. Two phases separate from the slurry: a light upper phase comprising deashing solvent and dissolved coal and a heavier lower phase comprising solid insoluble mineral ash, undissolved coal, dissolved coal and a small amount of deashing solvent. From the heavy phases withdrawn from the lower portion of the separator, deashing solvent is flashed off and passed to the earlier mixer. The remaining solid insoluble ash, undissolved coal and the dissolved coal referred to as ash concentrate are removed from the system, and passed to equipment for hydrogenation generation if so desired. The light phase from its first separator is withdrawn and passed into a second separation vessel. The temperature of this light phase is increased from about 600°-800° F., preferably from about 630°-700° F. while the pressure is maintained at about 750-1000 psig. In the second phase, separation occurs with a light phase rising to the top and a heavy phase settling to the bottom. The heavy phase is withdrawn with a reduction in pressure. Deashing solvent is flashed off for reintroduction into the critical solvent deashing system. The operation of the second separation can also be in such a manner to increase the density of the overhead fraction by including a portion of the soluble coal product which may in fact be a portion of the overall process solvent. The portion of the soluble coal product that is a coal liquefaction dissolving solvent need not be a distillable material, but can be recombined with a solvent isolated from the vacuum distillation tower. This heavier fraction of the process solvent system is generally referred to as light SRC since the composition is defined by solvent separation. When operating in such a manner as to make a light SRC material, the bottoms from the second separator will tend to be richer in benzene-insoluble material. Such material is heavy SRC.

Having described two preferred methods of operating the actual coal liquefaction reactor, namely; slurried catalyzed operation and ebullated bed operation as well as a preferred mode for separating the downstream of materials from distillation to classify ash from solvent-refined coal, the present invention will now be illustrated with reference to two overall embodiments of the process for the liquefaction of coal using treated solvent and recycled SRC. The preferred embodiment is illustrated in FIG. 1 while an alternate embodiment is illustrated in FIG. 2.

Figure 2:
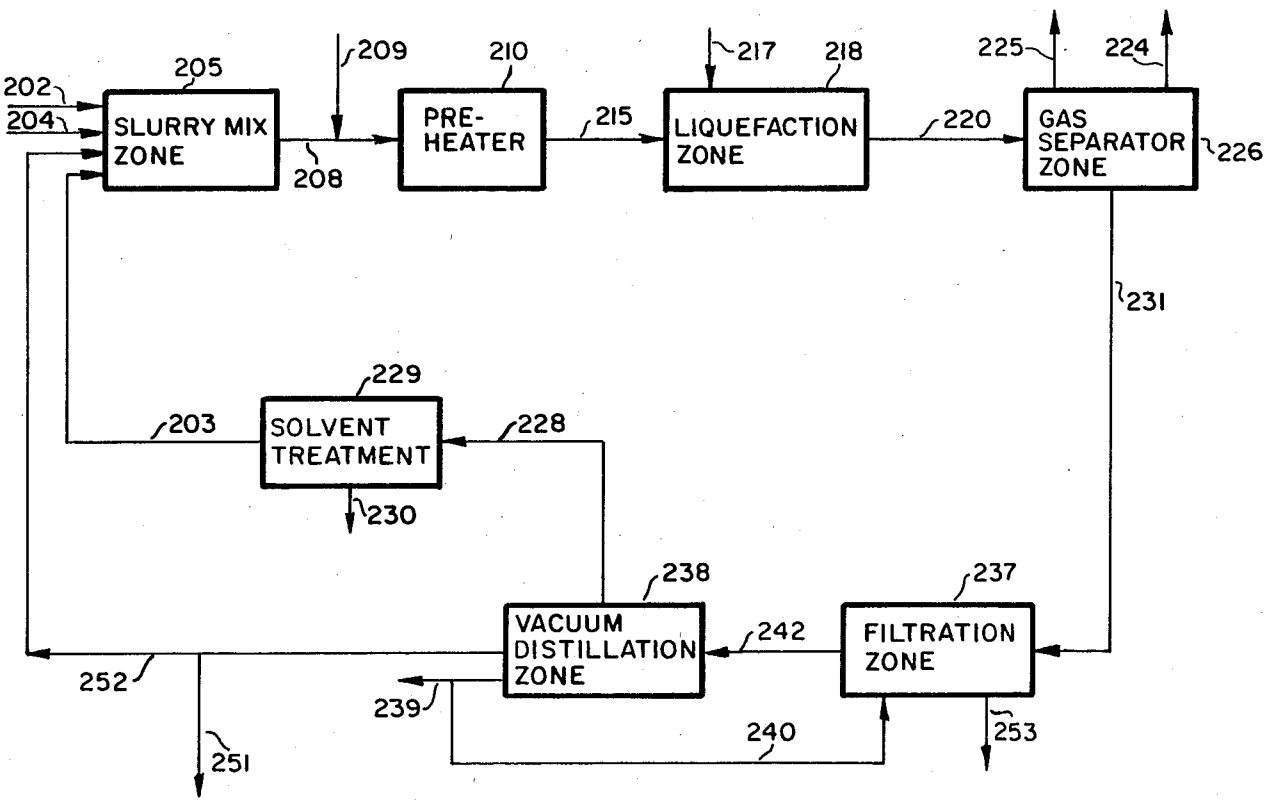
FIG. 2 represents a schematic flowscheme of an alternate embodiment of the present invention.

With reference to FIG. 1, the present invention will be described utilizing the slurry catalyst concept of operation. Raw or pretreated coal is introduced into a slurry mix zone 5 through line 4 while a catalyst is added in line 2. Treated recycle solvent is introduced in line 3 while an SRC fraction of solvent-refined coal is introduced in line 51. This mixture is blended to provide a slurry phase reaction feed in line 8. The feed is further blended with hydrogen-rich gas introduced in line 9. The mixture is then passed into preheater zone 10 where the temperature of the slurry is rapidly increased. The heated slurry is then passed through transfer line 15 to the liquefaction zone 18 which is comprised of one or more dissolvers. Additional hydrogen-rich gas is introduced into the slurry through line 17. If an ebullated bed reactor were being described rather than the slurry phase operation, this liquefaction zone 18 would be performed in an ebullated bed manner with catalyst retained in the ebullated bed. The gas slurry flow from liquefaction zone 18 is passed through transfer line 20 into a high pressure separator system 26 in which gaseous effluent is separated from the condensed phase. The gas phase is passed from the separator through line 24 to gas separation and purification area where hydrogen-enriched gases are separated and purified and passed to the preheater section 10 and the liquefaction zone 18 through lines 9 and 17, respectfully. Such downstream treatment of the gas effluents is not shown. If desired, the gas separation zone may be comprised of a series of step drops in pressure which produces other streams 25 substantially richer in material other than hydrogen which can be processed and used or sold as plant product.

The condensed phase from zone 26 is passed to a vacuum distillation zone 37 through line 31. A light distillate fraction boiling up to approximately 425° F. is passed from the zone through line 39 to storage. This fraction constitutes the product of the liquefaction process.

A recycle distillate solvent is passed from zone 37 through line 38 to the solvent treatment in zone 29. Heteroatom-rich extract is passed to storage via line 30. The treatment in zone 29 is commensurate with that described in U.S. Pat. No. 4,472,273 of identical inventive entity and common assignee. It involves dephenolating and denitrogenating the solvent by known techniques such as acidification and silica gel sorption. This patent is hereby incorporated herein by reference. The heteroatom-depleted solvent is passed via line 3 to the slurry mix zone 5.

The bottoms material from the vacuum distillation zone 37 which contains solvent-refined coal, unconverted coal macerals, spent catalyst and mineral matter is passed to a solid separation zone 44 through line 41. The solid separation zone is preferably the critical solvent deashing system as described above. A solid insoluble material is recovered from zone 44 and removed in line 45. This material can be passed to a gasifier to generate hydrogen if desired (not illustrated).

Deashed products from solid separation zone 44 having various compositions, specifically different levels of benzene insolubles, can be produced from this zone. A product having a low level of benzene insolubles is passed through line 48 and is characterized as light SRC. A product having a high level of benzene insolubles is removed in line 46 and is characterized as heavy SRC. In the preferred operation of the present invention, at least a portion, if not all of the light and heavy SRC is recycled in line 51 and line 49 for introduction in the slurry mix zone 5. Alternatively, either light SRC or heavy SRC individually may be recycled to the slurry mix zone 5.

In FIG. 2, an alternative flowscheme for performing the coal liquefaction of the present invention with either a slurry catalyzed system or an ebullated bed reactor is provided. The scheme of FIG. 2 utilizes filtration and distillation rather than a critical solvent deashing unit for the separation of product. Coal, in line 204, is introduced with catalyst in line 202 into a slurry mix zone 205. This mixture is combined with recycled SRC in line 252 and a recycle treated solvent in line 203. The slurry feed in line 208 is blended with a hydrogen-rich gas in line 209 and introduced into a preheater 210. The temperature of the gas/slurry feed is increased as described with reference to FIG. 1 above and the dissolving mixture is transferred in line 215 to the liquefaction zone 218 where additional hydrogen-rich gas may be introduced in line 217. The liquefaction reaction is preferably performed in a slurry phase continuous flow reaction manner. Alternatively, if catalyst is not introduced in line 202, the liquefaction zone 218 can be operated as an ebullated bed of catalyst particles through which the coal feed slurry is introduced in upflow fashion.

The liquefied coal, along with mineral matter, solvent, residual hydrogen and catalyst is removed in line 220 and introduced into a gas separator zone 226. Various gaseous constituents of the product can be removed in lines 224 and 225 if fractional separation is performed. If all gas is removed simultaneously, only one gas effluent in line 224 or 225 will be needed. The condensed phase from the gas separator zone 226 is removed in line 231 and introduced into a filtration zone 237. Solid material will be removed as a residue in line 253 while a filtrate including soluble material and a light recycling solvent from line 240 is removed in line 242 for vacuum distillation in zone 238.

In the vaccum distillation zone 238, a light solvent can be removed in line 239, a portion of which is recycled to the filtration zone in 240. A heavier solvent cut is removed in line 228 as recycle solvent and is treated in a solvent treatment zone 229 for the removal of heteroatoms such as nitrogenous bases and phenolic compounds in line 230. The treated solvent is then recycled in line 203 to the slurry mix zone 205. The vacuum bottoms from the vacuum distillation zone 238 constitute a full slate SRC which is removed in line 252. A portion of this product can be removed in line 251 as a fuel source product without further coal liquefaction treatment. The remaining vacuum bottom SRC is recycled to the slurry mix zone 205 through line 252.

The present invention, constituting the novel combination of treated solvent and recycled SRC, has been described in general terms with regard to various embodiment above. In the following examples and accompanying Tables, the unexpected advantage of this combination of features in a coal liquefaction technique or solvent refining procedure is set forth in laboratory derived results.

EXAMPLE 1

This example illustrates the treatment of process solvent to remove nitrogenous-bases and phenols. A sample of process solvent having the elemental composition shown in Table 1 was mixed in a beaker with n-pentane in 5:1 volume pentane to solvent ratio. Nitrogenous-bases were removed from the solution by bubbling anhydrous HCl through it for 10 minutes. Excess HCl was removed by passing nitrogen through the solution. The solution was then neutralized by bubbling ammonia through it. Excess ammonia was removed by passing nitrogen through the solution. The resulting solution was mixed with 100–200 mesh silica gel (the weight of silica gel was equivalent to the weight of original process solvent). The mixture was filtered to separate phenols from the solvent. Filtrate was rotoevaporated to recover the treated solvent. Elemental and solvent separation analyses of nitrogenous-base and phenol-free solvent are given in Table 1.

TABLE 1

ANALYSIS OF PROCESS SOLVENT

| | Weight % | |
|---|---|---|
| | Original Solvent | Nitrogenous-Base and Phenol Free Solvent |
| Elemental Analysis | | |
| Carbon | 87.89 | 89.43 |
| Hydrogen | 8.57 | 9.12 |
| Oxygen | 2.25 | 0.83 |
| Nitrogen | 0.67 | 0.12 |
| Sulfur | 0.62 | 0.60 |
| Distribution of Basic Nitrogen | | |
| N — No attached hydrogen | 0.28 | <0.01 |
| NH — One attached hydrogen | 0.15 | <0.01 |
| $NH_2$ — Two attached hydrogen | 0.24 | 0.12 |
| Distribution of Oxygen | | |
| O — No attached hydrogen | 1.10 | 0.60 |
| OH — One attached hydrogen | 1.15 | 0.23 |

EXAMPLE 2

This example illustrates the reaction of coal without any added catalyst in the presence of treated solvent. The feed slurry was comprised of Illinois #6 coal having the composition shown in Table 2 and a process solvent treated to remove both nitrogenous-bases and phenols as described in Example 1. A coal solvent slurry (3 g solvent and 3 g coal) was reacted in a 50 mL tubing-bomb reactor at a cold hydrogen pressure of 1200 psig. Reaction temperature of 440° C. and resistance time of 60 minutes were used. A reaction product distribution obtained was as shown in Table 3. Conversion of coal was 77% and the oil yield was 34% based on moisture-ash-free (maf) coal.

TA8LE 2

ANALYSIS OF ILLINOIS #6 COAL

| | Weight % (as received basis) |
|---|---|
| Proximate Analysis | |
| Moisture | 2.54 |
| Ash | 10.46 |
| Volatile | 37.56 |
| Fixed Carbon | 49.44 |
| Ultimate Analysis | |
| Carbon | 68.43 |
| Hydrogen | 4.96 |
| Nitrogen | 1.38 |
| Sulfur | 3.23 |
| Oxygen (by difference) | 8.93 |
| Distribution of Sulfur | |
| Total Sulfur | 3.23 |
| Pyritic Sulfur | 1.09 |

TA8LE 2-continued

ANALYSIS OF ILLINOIS #6 COAL

| | Weight % (as received basis) |
|---|---|
| Organic Sulfur | 2.14 |

EXAMPLE 3

This example illustrates the reaction of coal with molybdenum catalyst in the presence of treated solvent. The feed slurry described in Example 2 was mixed with 250 ppm of molybdenum based on coal as molybdenum octoate and reacted at the same conditions as described in Example 2. The reaction product distribution, presented in Table 3 as duplicate runs, showed significantly higher oil production and coal conversion than Example 2.

EXAMPLE 4

This example also illustrates the reaction of coal with molybdenum catalyst in the presence of treated solvent. The feed slurry described in Example 2 was mixed with 500 ppm of molybdenum based on coal and reacted at the same conditions as described in Example 2. The reaction product distribution shown in Table 3 was similar to that noted with 250 ppm of molybdenum.

EXAMPLE 5

This example illustrates the non-catalytic reaction of coal with SRC recycle in the presence of treated solvent. The feed slurry described in Example 2 was mixed with 1.4 g of SRC recovered from Examples 2, 3 and 4. The feed slurry, therefore, comprised of 3 g coal, 3 g solvent and 1.4 g recycle SRC. The feed slurry was reacted at the same conditions as described in Example 2. The reaction product distribution, summarized in Table 3, showed significantly higher oil production than Example 2. The addition of SRC resulted in significant increase in retrogressive reactions as evidenced by significant decrease in coal conversion. This low level of coal conversion (62%) is not desirable from a commercial point of view.

EXAMPLE 6

This example illustrates the present invention. In this example coal was reacted with molybdenum catalyst and in the presence of treated solvent. The feed slurry comprised of 3 g coal, 3 g solvent and 1.5 g of SRC recovered from Examples 2, 3 and 4. The feed slurry was also mixed with 250 ppm of molybdenum based on coal and reacted at the same conditions as described in Example 2. The reaction product distribution, summarized in Table 3, showed significantly higher oil production than Example 2, 3, 4 and 5. Coal conversion was also higher than Example 2 without any added SRC and Example 5 with added SRC. Coal conversion, however, was slightly lower than Examples 3 and 4.

EXAMPLE 7

This example also illustrates the present invention. The feed slurry was identical to that described in Example 6 except for the use of 500 ppm of molybdenum instead of 250 ppm. The reaction conditions were the same as described in Example 2. The reaction product distribution given in Table 3 was very similar to that noted in Example 6.

TABLE 3

| | Conversion and Product Distribution | | | | | | |
|---|---|---|---|---|---|---|---|
| | Ex. 2 No Catalyst | Ex. 3 2500 ppm Mo | | Ex. 4 500 ppm Mo | Ex. 5 No Catalyst + SRC | Ex. 6 250 ppm Mo + SRC | Ex. 7 500 ppm Mo + SRC |
| Product Distribution, Wt. % MAF Coal | | I | II | | | | |
| Gas | 11.3 | 11.5 | 10.2 | 11.2 | 10.5 | 13.0 | 12.7 |
| Oil | 33.9 | 50.1 | 51.7 | 53.4 | 44.6 | 69.5 | 71.4 |
| SRC | 32.2 | 31.9 | 31.3 | 29.4 | 7.0 | 5.8 | 6.9 |
| IOM | 22.6 | 6.5 | 6.5 | 6.0 | 37.9 | 11.7 | 9.0 |
| Conversion | 77.4 | 93.5 | 93.2 | 94.0 | 62.1 | 88.3 | 91.0 |

Gas - $C_1$–$C_5$, CO, CO, $H_2S$
Oil - Pentane Solubles
SRC - Pentane insolubles, methylene chloride/methanol solubles
IOM - Methylene chloride/methanol insolubles As set forth in Table 3 above, the present invention exemplified in Example 6 and Example 7 combining a full slate recycle SRC as well as a solvent treated to remove nitrogenous bases and phenolic materials provides an unexpected increase in the oil make for a coal liquefaction or solvent refining process. The desired product of coal liquefaction or solvent refining is the production of liquid fuels which would replace present petroleum based liquid fuels. The present invention specifically provides a substantial increase in the oil-make for a given conversion of feed coal. The overall conversions of 88.3 and 91%, respectively for Examples 6 and 7, although numerically lower than the control catalyzed runs of Examples 3 and 4 are considered of similar magnitude and of an insubstantial difference particularly with regard to the considerable oil-make improvement provided by Examples 6 and 7 despite the slightly lower overall conversion. In any process which seeks the maximum make of liquid product from a solid feed material, a certain amount of gases are inevitably coproduced. However, such gases are deemed undesirable because of the large quantity of hydrogen necessary for their formulation and because the gaseous products are economically less attractive than liquid products. Therefore, although the gas make for Examples 6 and 7 which exemplify the present invention are higher than the gas makes for the proceeding examples, such gas makes are decidedly lower than what would be expected for the heightened conversion to oils of the solid coal. As demonstrated by the numbers in Table 3 the present invention achieves a conversion of the SRC fraction into oil production without a significant increase in gas make. Therefore the significantly reduced values of the SRC product for Examples 6 and 7 when viewed in combination with the significant increase in the oil values for Examples 6 and 7 show the unexpected specificity of the process of the present invention for the production of the desired product liquid oils from solid coal feed material.

The present invention has been described with reference to several preferred embodiments. Those skilled in the art will be capable of contemplating various obvious variations thereto which are deemed to be within the scope of the present invention. Therefore, the scope of the present invention should not be limited to those preferred embodiments, but rather should be ascertained from the claims which follow.

We claim:

1. A process for the catalytic solvent refining of coal comprising contacting coal at elevated temperature and pressure in a hydrogen atmosphere and using a hydrocarbon solvent boiling in the range of 350° to 950° F. in which a predominant amount of the phenolic and nitrogenous base constituents from the solvents are removed when the solvent is recycled and the solvent refining is performed in the presence of an added catalyst to produce liquid hydrocarbons and normally solid, solvent-refined coal wherein at least a portion of the pyridine-soluble, pentane-insoluble solvent-refined coal is recycled to the process.

2. The process of claim 1 wherein at least a portion of a predominantly benzene-insoluble solvent-refined coal is recycled to the process.

3. The process of claim 1 wherein a predominantly benzene soluble solvent refined coal is recycled to the process.

4. The process of claim 1 wherein the catalyst is molybdenum or a compound thereof.

5. The process of claim 1 wherein the catalyst is present in an amount in the range of 10 to 10,000 parts per million of coal feed.

6. The process of claim 1 wherein the catalyst is selected from Group VI and VIII metals including tungston, iron, cobalt, nickel and mixtures thereof.

7. The process of claim 1 wherein the solvent refined coal is recycled in an amount of between 2 and 50% of the feed coal.

8. The process of claim 1 wherein the solvent refined coal is recycled in an amount of between 10 to 50% of the feed coal.

* * * * *